US006679305B2

(12) United States Patent
Petersen

(10) Patent No.: US 6,679,305 B2
(45) Date of Patent: Jan. 20, 2004

(54) FENCE ASSEMBLY FOR TABLE SAW

(75) Inventor: James B. Petersen, Calgary (CA)

(73) Assignee: 556218 Alberta Ltd., Calgary (CA); part interest ( * ) Notice: Subject to any disclaimer, the term of this patent is extended or adjusted under 35 U.S.C. 154(b) by 169 days.

(21) Appl. No.: 10/052,352

(22) Filed: Jan. 23, 2002

(65) Prior Publication Data

US 2002/0096029 A1 Jul. 25, 2002

(51) Int. Cl.[7] ..... B27C 1/14

(52) U.S. Cl. ..... 144/253.1; 83/440; 83/468.3; 83/435.12; 144/286.1

(58) Field of Search ..... 83/468.3, 477, 83/581, 743, 745, 440, 473, 574, 477.2, 471.3, 478, 435.12, 435.13, 435.14, 435.11, 471.2; 144/253.1–253.9, 286.1, 287, 285

(56) References Cited

U.S. PATENT DOCUMENTS 2,696,854 A * 12/1954 Woodruff ..... 83/435.14
3,138,180 A * 6/1964 Schultz ..... 33/500
4,186,784 A * 2/1980 Stone ..... 144/253.2
4,259,887 A * 4/1981 Dean ..... 83/435.14
4,655,445 A * 4/1987 Morse ..... 269/304
4,995,435 A * 2/1991 Godfrey ..... 144/363
5,823,239 A * 10/1998 Smith ..... 144/135.2
6,305,449 B1 * 10/2001 Stover ..... 144/371

* cited by examiner

*Primary Examiner*—Allan N. Shoap
*Assistant Examiner*—Phong Nguyen
(74) *Attorney, Agent, or Firm*—George A. Seaby

(57) ABSTRACT

A fence assembly for a table saw includes a track for mounting on one edge of the table saw perpendicular to a slot in the table top of the saw and a blade in the slot, a carriage slidable on the track, a fence rotatable on the carriage for defining a straight guide edge at any angle from 0 to 90° with respect to the blade, and a guide plate above the fence with indicia thereon for accurately positioning the fence. A pair of bolts extend upwardly from the carriage through arcuate slots in the fence to the guide plate for slidably supporting the fence. Knobs on the top of the bolts are used to releasably clamp the fence between the guide plate and the carriage.

7 Claims, 5 Drawing Sheets

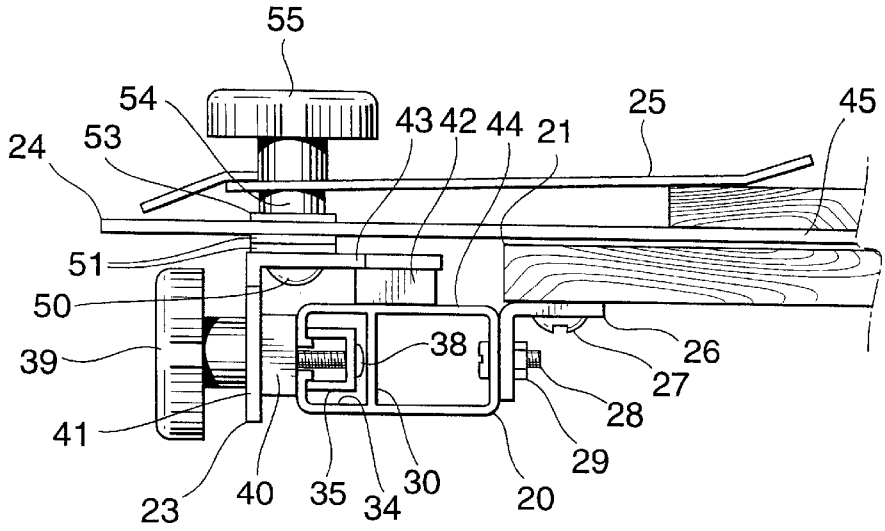
FIG. 4
FIG. 5
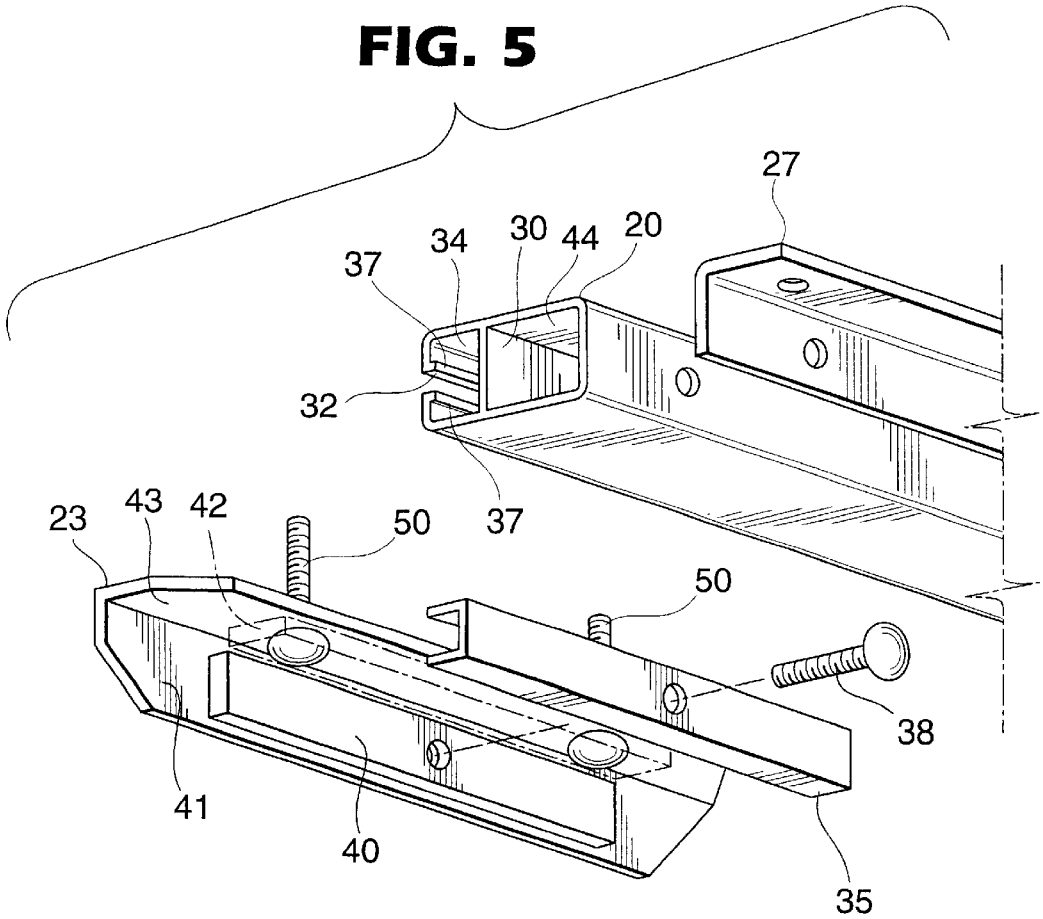

FENCE ASSEMBLY FOR TABLE SAW

BACKGROUND OF THE INVENTION

1. Field of the Invention

This invention relates to a fence assembly for use on a table saw.

Specifically, the invention relates to a fence assembly for use on a table saw, which includes a rectangular table top and a slot extending longitudinally of the table top for receiving a circular saw blade. While the fence assembly disclosed herein was designed specifically for use with a table saw of the type disclosed in the inventor's Canadian Patent Application Serial No. 2,119,279, filed Mar. 16, 1994, it will be appreciated that the assembly can be used on other table saws with fixed or movable blades.

2. Discussion of the Prior Art

Fences for table saws are described in U.S. Pat. No. 2,032,976, which issued to R. L. Carter on Mar. 3, 1936; U.S. Pat. No. 2,064,607, which issued to J. A. Hirtz, Sr. on Dec. 15, 1936; U.S. Pat. No. 2,310,813, which issued to G. J. Sellmeyer on Feb. 9, 1943; U.S. Pat. No. 2,954,062, which issued to E. Leitchner on Sep. 27, 1960; U.S. Pat. No. 2,968,325, which issued to T. S. Wandvik on Jan. 17, 1961; U.S. Pat. No. 3,465,797, which issued to M. R. Kimber on Sep. 9, 1969; U.S. Pat. No. 4,265,154, which issued to W. A. Batson on May 5, 1981; U.S. Pat. No. 4,455,907, which issued to A. L. Bassett on Jun. 26, 1984; U.S. Pat. No. 5,038,485, which issued to J. S. Ducate, Sr., on Aug. 13, 1991; U.S. Pat. No. 5,181,448, which issued to D. A. Terpstra on Jan. 26, 1993 and U.S. Pat. No. 5,611,525, which issued to W. M. Bishop on Mar. 18, 1997. In general, the patented fences are complicated and expensive to manufacture. The more recent devices of this type require custom metal castings, and machined elements.

GENERAL DESCRIPTION OF THE INVENTION

The object of the present invention is to provide a relatively simple fence assembly for use with a table saw which is easy to produce and consequently inexpensive. The main components of the present invention are formed of simple aluminum extrusions or thin, bent aluminum sheets which lend themselves to mass production.

Another object of the invention is to provide a fence assembly for use with a table saw which is easy to use, i.e. easy to move along the edge of a saw table and readily rotated to change the angle of the fence with respect to a saw blade.

Accordingly, the invention relates to a fence assembly for use on a table saw including a table top, a slot extending longitudinally of the table top, and a blade extending through said slot for cutting a workpiece, said assembly comprising:

(a) a track for mounting on one side edge of said table top perpendicular to said slot;

(b) a carriage slidable on said track for movement along said one side edge;

(c) a fence slidable on said carriage for movement therewith, said fence including (i) a top plate for overlapping the table top of the saw;

(ii) a straight edge on one side of said top plate for guiding a workpiece on the table top;

(iii) a first arcuate slot in said top plate, a line through the ends of the first slot being parallel to said straight edge; and (iv) second arcuate slots intersecting said first arcuate slot on eithr side of the center thereof;

(d) a guide plate above said top plate for rectilinear movement with said carriage along said one side of the table top;

(e) guide posts extending upwardly from said carriage through said first slot and said guide plate permitting rotation of the fence between said carriage and said guide plate whereby the fence can be rotated through 180° around vertical axes defined by said guide posts between positions in which said straight edge is parallel to said slot in the table top on either side of the slot.

BRIEF DESCRIPTION OF THE DRAWINGS

The invention is described in greater detail hereinafter with reference to the accompanying drawings, which illustrate a preferred embodiment of the invention, and wherein:

FIG. 4 is an end view of the fence assembly as seen from the right of FIG. 1;

FIG. 5 is an exploded, isometric view of the fence assembly with parts omitted.

DESCRIPTION OF THE PREFERRED EMBODIMENT

Figure 1:
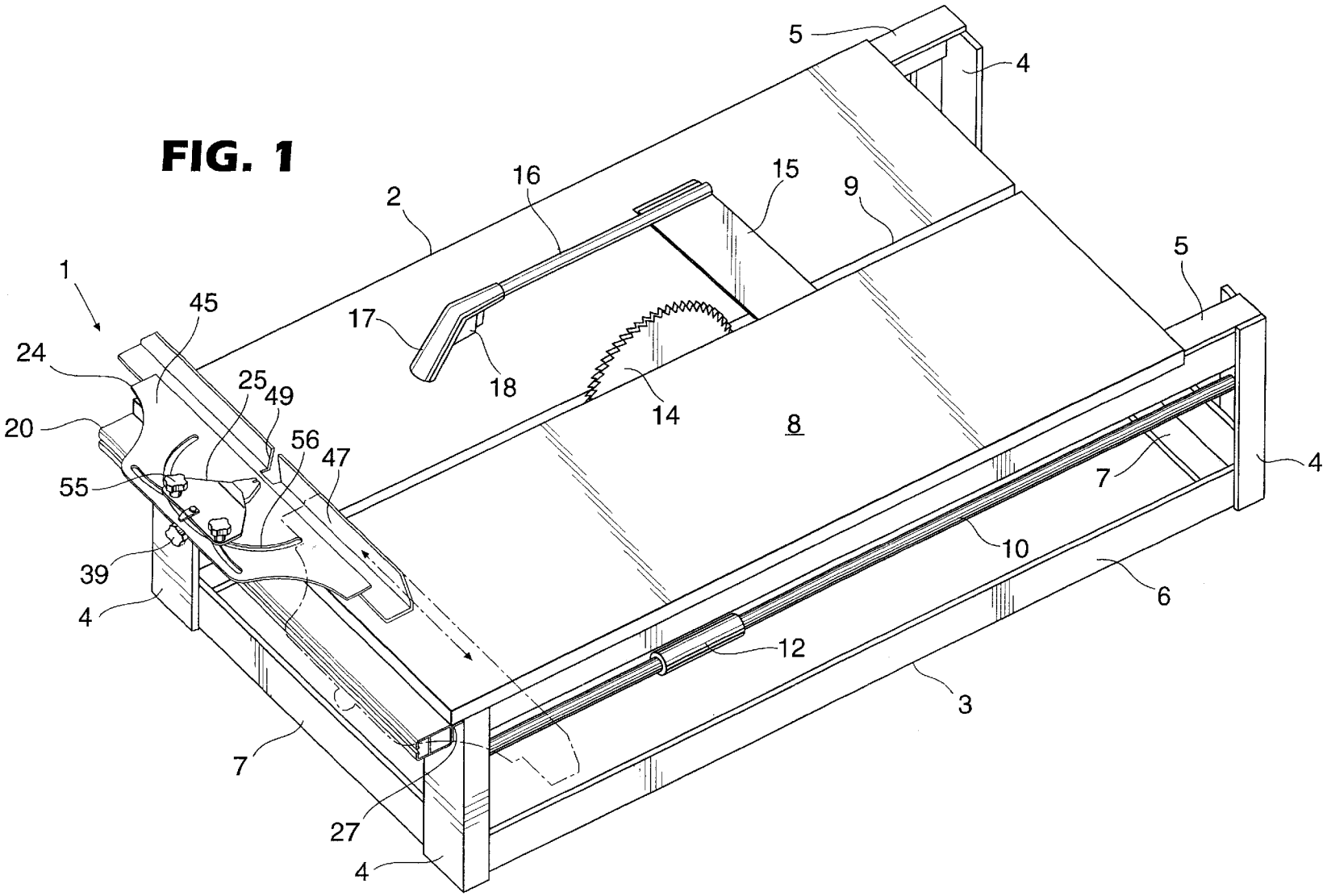
FIG. 1 is an isometric view of a table saw with a fence assembly in accordance with the invention mounted thereon.

With reference to FIG. 1, the fence assembly, which is generally indicated at 1 was originally designed for use on a table saw disclosed in the inventor's U.S. Pat. No. 5,842,400, issued Dec. 1, 1998. The table saw includes a table 2, the base of which is defined by a frame 3 including four legs 4, longitudinally extending top and bottom bars 5 and 6, respectively, and cross braces 7. A table top 8 is mounted on the frame 3. A slot 9 extends longitudinally through the top 8 along substantially the entire length thereof. A rail 10 (one shown) extends longitudinally along each side of the frame 2 beneath the table top 8 between the legs 4. A cylindrical bushing 12 is slidably mounted on each rail 10 for slidably supporting a carriage and circular saw assembly (not shown) beneath the table top 8.

The saw assembly includes a blade 14 extending through the slot 9. The carriage and saw assembly are caused to move along the rails 10 using a splitter plate or arm 15 extending upwardly through the slot 9. A tubular arm 16 extends forwardly from the top end of the arm 15, and a handle 17 with a trigger 18 are mounted on the outer free end of the arm 16. As described in U.S. Pat. No. 5,842,400, the handle 17 and the trigger 18 are used for manual starting and stopping of the saw, and for moving the carriage and saw assembly longitudinally of the table. During sawing, the splitter plate 15 maintaines the sides of a slot cut in a wooden workpiece apart.

The fence assembly 1 includes a tubular track 20 mounted on one side edge 21 (in this case the front end) of the table top 8. The track 20, which is a simple channel member formed from an aluminum extrusion, slidably supports a carriage 23 (FIGS. 3 to 5), a fence 24 and a guide plate 25. As best shown in FIG. 4, the track 20 is generally rectangular in cross section and extends across the entire front edge 21 of the table top 8. The track 20 is mounted beneath the edge 21 of the table top 8 by means of an inverted L-shaped bracket 26, which is attached to the table top by screws 27 (one shown). The track 20 is connected to the bracket 26 by bolts 28 and nuts 29 (one shown—FIG. 4).

A vertical partition 30 extends the length of the interior of the track 20. A slot 32 (FIG. 5) in the outer side of the track 20 opens into a longitudinally extending channel 34, which receives a generally C-shaped latch 35, the open side of which faces outwardly. Vertical movement of the latch 35 is prevented by inwardly extending flanges 37 at the top and bottom of the slot 32. The carriage 23, which is merely a strip of aluminum with an inverted L-shaped cross section, is connected to the latch 35 by a carriage bolt 38 and an internally threaded knob 39. The bolt 38 extends through the latch 35, a plastic slide 40 on the inside surface of the vertical arm 41 of the carriage 23 and the vertical arm 41 itself into a threaded cavity (not shown) in the knob 39. By loosening the knob 39, the carriage 23 is released from a latched position for sliding along the track 20. By tightening the knob 39, the slide 40 is pressed against the outer side of the track 20 to fix the carriage 23 in one position. A second plastic slide 42 is provided on the bottom surface of the horizontal top arm 43 of the carriage 23 for riding on the top wall 44 of the track 20.

As mentioned above, the fence 24 is mounted on the carriage 23 for movement therewith along the side edge 21 of the table top 8. The fence 24 is defined by a generally rectangular plate 45 with tapering arms 46 integral with and extending outwardly from the ends thereof, and an elongated straight edge 47, which has an L-shaped cross section, connected to one straight side 48 of the plate 45. In this connection, it will be noted that one straight side of each arm 46 defines a continuation of the straight side of the plate 45. An opening 49 is provided in the center of the straight edge 47 for admitting the saw blade 14 when making a crosscut perpendicular to the blade, i.e. with the fence in the position shown in FIG. 1. The fence 24 is connected to the slide 23 for movement therewith along the track 20 by a pair of carriage bolts 50 extending upwardly through the horizontal top arm 43 of the carriage 23.

Figure 2:
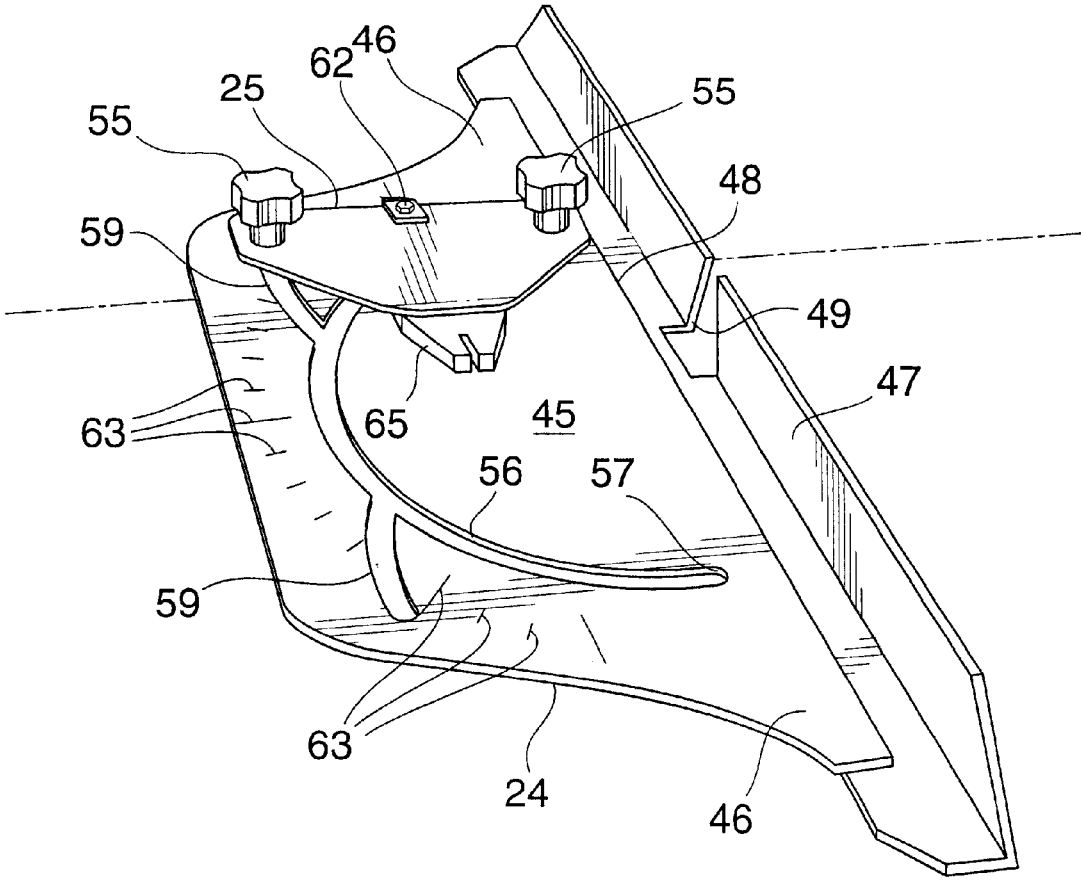
FIG. 2 is a perspective view of the fence assembly from above and one end, with parts omitted.
Figure 3:
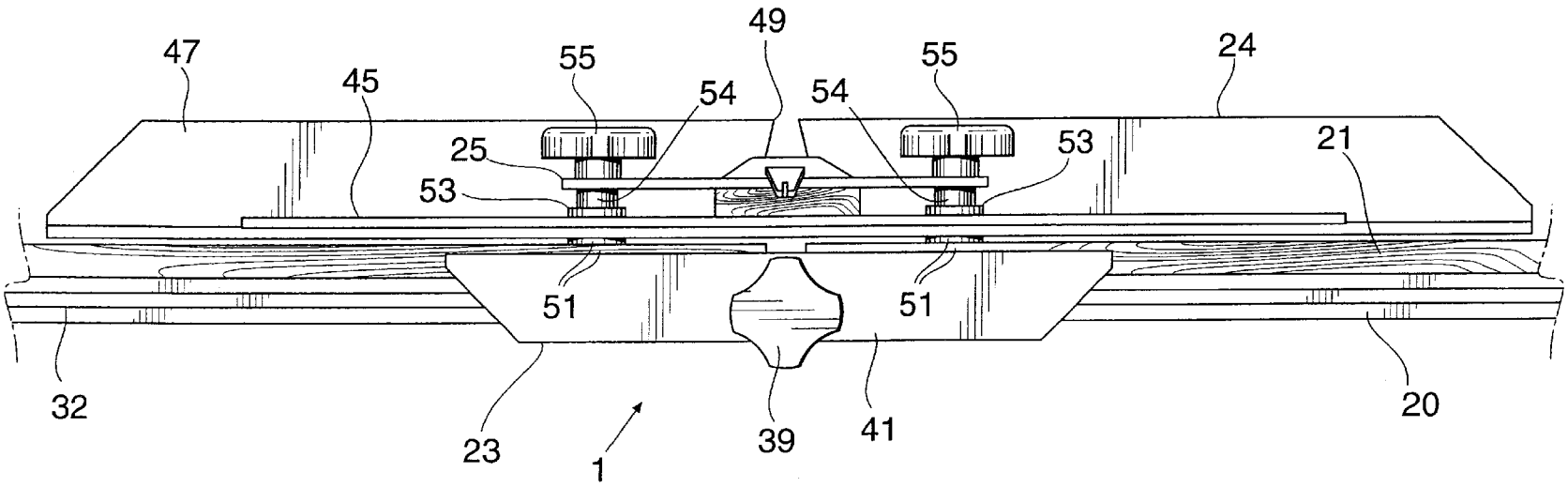
FIG. 3 is a front view of the fence assembly.
Figure 6:
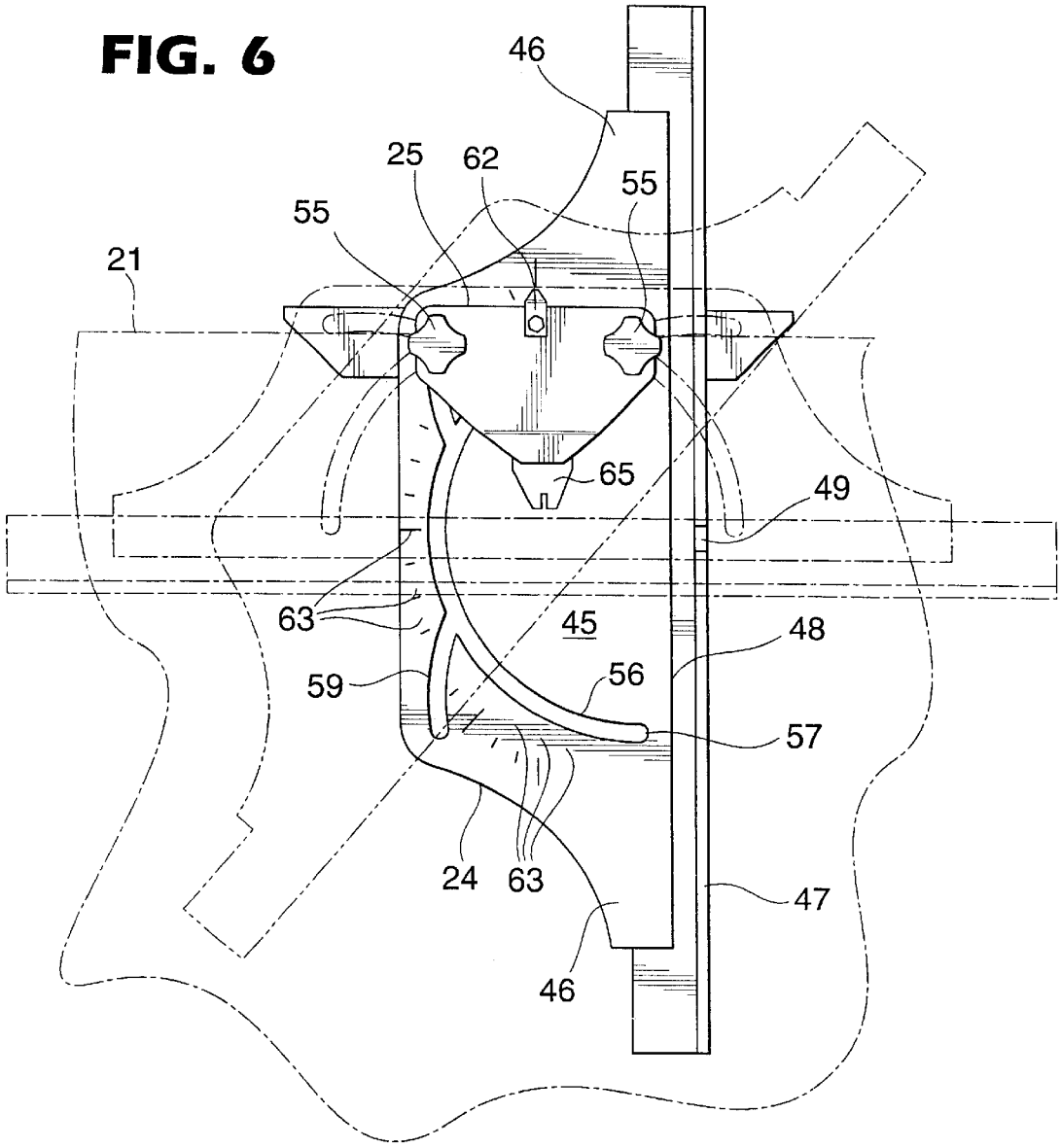
FIG. 6 is a schematic top view of the fence assembly showing the fence in a variety of positions.

Each bolt 50 extends upwardly through a pair of washers 51, the plate 45 of the fence 24, another washer 53, a sleeve 54 and the guide plate 25 into an internally threaded knob 55. With this arrangement, (as shown in FIGS. 3 and 4), the plate 45 is spaced a short distance apart from the table top 8. Thus, there is no resistance form the table top 8 to rotation of the plate 45. In order to permit rotation of the fence 24 with respect to the edge 21 of the table top 8, a generally semicircular slot 56 is provided in the plate 46 of the fence. The ends 57 of the slot 56 are near the straight edge 49 of the plate 46 (not shown). A line through the ends 57 would be parallel to the edge 49 and the straight edge 48. The length and curvature of the slot 56, and the spacing between the bolts 50 are such that the fence 24 can rotate freely relative to the slide 23 without sticking or bending. Short arcuate slots 59 (FIGS. 1, 2 and 6) extending from proximate the outer corners of the plate 45 intersect the slot 56 at approximately one-third the distance from either end thereof. The slots 56 and 59 permit rotation of the straight edge 47 of the fence 24 from a position perpendicular to the slot 9 and the blade 14 (FIG. 1, and phantom outline in FIG. 6) to a position parallel to the, blade 14 (shown in solid outline in FIG. 6) on either side of the blade. It will be appreciated that in the absence of the slots 59, it would not be possible to position the straight edge parallel to the slot 9 in the saw table top 8.

A pointer 62 is provided on one side of the guide plate 25 for alignment with indicia or lines 63 in the form of straight grooves or painted marks on the plate. The indicia 63 provide an indication of the angle between the straight edge 47 and the blade 14. A second notched pointer 65 is provided on the opposite side of the guide plate 25 for supporting the other side of the plate on the top plate 45 of the fence 24.

During use, with the straight edge 47 parallel to the edge 21 of the table top 8 (FIG. 1), the assembly is used to position a wooden workpiece (not shown) perpendicular to the slot 9 and the blade 14, e.g. for making a crosscut in the workpiece. In such position, the pointer 62 is aligned with the central line 63, indicating that the straight edge 47 is perpendicular to the blade 14. By loosening the knobs 55, the fence 24 is released for rotation to change the angle of the fence with respect to the plane of the blade 14 for making an angle cut.

When the straight edge 47 is to be parallel to the blade 14, the knobs 55 are loosened and the fence 24 is rotated. When the trailing bolt 50 (in the direction of fence rotation) reaches one of the slots 59, the bolt enters the slot, so that the plate 45 can continue to rotate to a position (shown in solid lines in FIG. 6) in which the straight edge 47 is perpendicular to the side edge 21 of the table top 8 and parallel to the slot 9 and the saw blade 14. In order to adjust the lateral spacing between the straight edge 47 and the blade 14, the knob 39 is loosened and the carriage 23 is slid along the track 20 until the fence 24 reaches the desired position, when the knob 39 is again tightened.

I claim:

1. A fence assembly for use on a table saw including a table top, a slot extending longitudinally of the table top, and a blade extending through said slot for cutting a workpiece, said assembly comprising:

(a) a track for mounting on one side edge of said table top perpendicular to said slot;

(b) a carriage slidable on said track for movement along said one side edge;

(c) a fence slidable on said carriage for movement therewith, said fence including
  (i) a top plate for overlapping the table top of the saw;
  (ii) a straight edge on one side of said top plate for guiding a workpiece on the table top;
  (iii) a first arcuate slot in said top plate, a line through the ends of the first slot being parallel to said straight edge; and
  (iv) second arcuate slots intersecting said first arcuate slot on either side of the center thereof;

(d) a guide plate above said top plate for rectilinear movement with said carriage along said one side of the table top;

(e) guide posts extending upwardly from said carriage through said first slot and said guide plate permitting rotation of the fence between said carriage and said guide plate whereby the fence can be rotated through 180° around vertical axes defined by said guide posts between positions in which said straight edge is parallel to said slot in the table top on either side of the slot.

2. The fence assembly of claim 1, wherein said track includes a hollow channel member for mounting on said one side edge of the table top, a longitudinally extending, straight guide slot in said outer side of said channel member, and a latch in said channel member connected to said carriage for sliding therewith along the track and for releasably locking the carriage in one position, whereby the lateral spacing between said straight edge and the saw blade can be adjusted.

3. The fence assembly of claim 1, wherein said carriage includes a strip of metal with an inverted L-shaped cross section, said strip having a horizontal top arm for sliding on a top wall of said channel member, and a vertical arm for sliding on a front wall of said channel member.

4. The fence assembly of claim 3, including a first plastic slide on a bottom surface of said horizontal arm of the strip; and a second plastic slide on an inner surface of the vertical arm of the strip for sliding on said channel member.

5. The fence assembly of claim 1, wherein said first arcuate slot is substantially semi-circular, a line through the ends of said first slot being parallel to said straight edge.

6. The fence of claim 1, wherein said second slot intersect said first slot approximately one-third of the distance from either end thereof.

7. The fence of claim 1, including indicia on said fence top plate; and a pointer on said guide plate for alignment with said indicia for indicating the orientation of said straight edge with respect to the blade.

* * * * *